US009771725B2

(12) United States Patent
Matchung

(10) Patent No.: US 9,771,725 B2
(45) Date of Patent: Sep. 26, 2017

(54) MODULAR FLOORING SYSTEM

(71) Applicant: John Bradley Matchung, West Vancouver (CA)

(72) Inventor: John Bradley Matchung, West Vancouver (CA)

( * ) Notice: Subject to any disclaimer, the term of this patent is extended or adjusted under 35 U.S.C. 154(b) by 10 days.

(21) Appl. No.: 14/904,623

(22) PCT Filed: Jul. 4, 2014

(86) PCT No.: PCT/CA2014/000553
§ 371 (c)(1),
(2) Date: Jan. 12, 2016

(87) PCT Pub. No.: WO2015/006855
PCT Pub. Date: Jan. 22, 2015

(65) Prior Publication Data

US 2016/0153202 A1 Jun. 2, 2016

Related U.S. Application Data

(60) Provisional application No. 61/846,432, filed on Jul. 15, 2013.

(51) Int. Cl.
*E04F 15/02* (2006.01)
*E04F 15/024* (2006.01)
(Continued)

(52) U.S. Cl.
CPC ..... *E04F 15/02405* (2013.01); *E01C 5/20* (2013.01); *E01C 9/086* (2013.01);
(Continued)

(58) Field of Classification Search
CPC ..... E04F 15/02194; E04F 15/02172; E04F 2201/091; E04F 2201/095;
(Continued)

(56) References Cited

U.S. PATENT DOCUMENTS 2,950,575 A * 8/1960 Hellwig ..... E04C 1/397 174/491
4,018,025 A 4/1977 Collette
(Continued)

FOREIGN PATENT DOCUMENTS

WO 2008015045 A1 2/2008

OTHER PUBLICATIONS

International Search Report issued in corresponding International Application No. PCT/CA2014/000553, dated Sep. 2, 2014, 3 pages.
(Continued)

*Primary Examiner* — Rodney Mintz
*Assistant Examiner* — Daniel Kenny
(74) *Attorney, Agent, or Firm* — Lowe Graham Jones PLLC

(57) ABSTRACT

A first floor panel is provided that is connectable to a second floor panel in an array having a contiguous channel for retainably housing a cable. The array includes repeating units, each including one or more floor panels. The contiguous channel is formed through, between or through and between respective units. The first floor panel includes a body having a generally planar top surface, a bottom surface defining a bottom plane, and a first side. The first side includes an upper cable-retaining lip and a lower interlocking support. The interlocking support includes an interlocking support that is shaped to interlock with a corresponding side of the second floor panel to form a channel segment between the first side and the corresponding side of the second floor panel. The channel segment is adapted to retainably house the cable, spaced apart from the bottom plane. A modular flooring system is also provided involving a plurality of interconnectable floor panels.

20 Claims, 20 Drawing Sheets

(51) Int. Cl.
*E01C 5/20* (2006.01)
*E01C 9/08* (2006.01)
*E04F 15/10* (2006.01)

(52) U.S. Cl.
CPC ..... *E04F 15/02022* (2013.01); *E04F 15/10* (2013.01); *E01C 2201/12* (2013.01); *E04F 2201/023* (2013.01); *E04F 2201/091* (2013.01); *E04F 2201/095* (2013.01)

(58) Field of Classification Search
CPC ..... E04F 15/02405; E01C 13/045; E01C 2201/12; H02G 3/283
See application file for complete search history.

(56) References Cited

U.S. PATENT DOCUMENTS 5,197,244 A * 3/1993 Takeda ..... E04F 15/02405 52/126.5
5,263,289 A 11/1993 Boyd
5,787,654 A * 8/1998 Drost ..... E01C 5/20 52/177
5,907,934 A * 6/1999 Austin ..... E04F 15/082 404/34
6,076,315 A * 6/2000 Kondo ..... H02G 3/285 52/220.1
D497,213 S 10/2004 Poliacek et al.
7,490,443 B1 2/2009 Lovald et al.
D634,029 S 3/2011 Jianzhong
7,921,618 B2 4/2011 Lovald et al.
8,006,443 B2 8/2011 Fuccella et al.
D732,208 S * 6/2015 Matchung ..... D25/138
2003/0084626 A1 5/2003 Hsieh
2009/0282769 A1 11/2009 Moller, Jr.
2010/0275541 A1 11/2010 Prinz
2011/0107706 A1 5/2011 Fleishman
2011/0120037 A1 5/2011 Barlow

OTHER PUBLICATIONS

International Preliminary Report on Patentability issued in corresponding International Application No. PCT/CA2014/000553, dated Jan. 19, 2016, 5 pages.

* cited by examiner

MODULAR FLOORING SYSTEM

CROSS-REFERENCE TO RELATED APPLICATIONS

This application is a U.S. National Phase Application of International Application No. PCT/CA2014/000553, filed Jul. 4, 2014, which claims priority to U.S. Provisional Application No. 61/846,432, filed Jul. 15, 2013; the benefit of the subject matter of the foregoing are hereby claimed and incorporated herein by reference in their entirety.

FIELD OF INVENTION

The present invention generally relates to flooring. In particular, the present invention relates to floor panels and modular flooring systems.

BACKGROUND

Modular flooring systems are useful for a variety of indoor and outdoor applications, including military applications, factory floors, temporary roadways, trade shows, outdoor gatherings, and stages, among others. For example, during installation or use of a tactical command post, terrain may be too sandy, wet, soft, uneven, or otherwise unsuitable, creating tripping or shock hazards for equipment operators. In such circumstances, modular flooring systems facilitate the creation of a dry, sturdy and generally flat floor that can be rapidly assembled to fit various spaces.

Conventional modular flooring systems have a number of drawbacks. Individual panels can be too large or bulky for easy transport. They can require specialized tools or expertise to assemble. Connections between floor panels can be too inflexible to be suitable on uneven terrain, causing connections to inadvertently separate or even break. Additionally, many modular flooring systems do not provide a sub-floor cable management system.

SUMMARY OF THE INVENTION

In accordance with an aspect of the present invention, there is provided a first floor panel connectable to a second floor panel in an array having a contiguous channel for retainably housing a cable. The array includes repeating panel units and each panel unit of the repeating panel units includes one or more floor panels. The contiguous channel is formed through, between or through and between respective panel units. The first floor panel includes a body having a generally planar top surface, a bottom surface defining a bottom plane, and a first side. The first side includes a cable-retaining lip proximal to the top surface and an interlocking support proximal to the bottom plane. The interlocking support includes an interlocking surface that is shaped to interlock with a corresponding side of the second floor panel to form a segment of the contiguous channel between the first side of the first floor panel and the corresponding side of the second floor panel. The segment of the contiguous channel is adapted to retainably house the cable, spaced apart from the bottom plane.

The interlocking support may be shaped to interlock with the corresponding side of the second floor panel such that movement of the first floor panel relative to the second floor panel is restricted along a lateral plane parallel to the bottom plane. The interlocking support may be shaped to interlock with the corresponding side of the second floor panel such that movement of the first floor panel relative to the second floor panel is restricted along a transverse plane perpendicular to the lateral plane. The interlocking support may be shaped to interlock with the corresponding side of the second floor panel such that the first floor panel is movable relative to the second floor panel along the lateral plane between a seated and unseated position and movement along the transverse plane of the first floor panel relative to the second floor panel is restricted in the seated position and not restricted in the unseated position.

The interlocking support may include one or more generally T-shaped projections which each extend and widen outward from the first side along the lateral plane. The interlocking support may include one or more generally T-one or more generally T-shaped retainers respectively shaped and disposed for retaining corresponding generally T-shaped projections of the second floor panel corresponding to the one or more generally T-shaped projections of the first floor panel. The interlocking support may include one or more generally T-shaped projections which each extend and widen outward from the first side along the lateral plane and one or more generally T-shaped retainers respectively shaped and disposed for retaining corresponding generally T-shaped projections of the second floor panel corresponding to the one or more generally T-shaped projections of the first floor panel.

The one or more generally T-shaped projections may include a plurality of generally T-shaped projections which extend and widen outward from the first side along the lateral plane. The one or more generally T-shaped retainers may include a plurality of generally T-shaped retainers respectively shaped and disposed for retaining corresponding generally T-shaped projections of the second floor panel corresponding to the one or more generally T-shaped projections of the first floor panel.

The interlocking support may further include an interlocking surface defining a first portion and a second portion juxtaposed along the lateral plane, the one or more generally T-shaped projections may include first and second generally T-shaped projections spaced apart on the first portion, and the one or more generally T-shaped retainers may include first and second generally T-shaped retainers spaced apart on the second portion.

The interlocking surface may include either or both of curved projections extending outward from the first side and curved recesses shaped and disposed to receive corresponding curved projections of the second floor panel corresponding to the curved projections of the first floor panel. The curved projections may be disposed on the first portion with the curved recesses disposed on the second portion.

The first side may be from about 75 cm to about 100 cm across the lateral plane and from about 3 cm to about 5 cm across the transverse plane.

The first floor panel may further include a second side and a hypotenusal side such that the first side, the second side, and the hypotenusal side together define an isosceles right triangle, wherein the hypotenusal side includes connecting means for connecting to a corresponding hypotenusal side of the second floor panel such that the first floor panel and the second floor panel together form a square floor panel.

The hypotenusal side may further include an inner face, an outer face, a retainer extending outward from the outer face proximal to the bottom plane, and a retainable member formed between the inner face and the outer face and oriented towards the bottom plane, wherein the retainer defines a trench open towards the top surface and shaped and disposed to retain a corresponding retainable member disposed on the second floor panel. The second side may be the same as the first side.

The bottom surface may include support ribs for supporting the top surface. The first side may define a first side plane and the support ribs extend perpendicular to and parallel to the first side plane. The support ribs may define first cutout regions for increasing flexibility of the body.

The bottom surface may further include structural ribs disposed between the support ribs and which are transversely shorter than the support ribs. Furthermore, the structural ribs may define second cutout regions for increasing flexibility of the body.

The support ribs may further include a stacking projection transversely extending away from the bottom plane and the top surface may define an opening disposed and shaped to receive a corresponding stacking projection of the second floor panel when the second floor panel is stacked on the top surface of the first floor panel, for reducing lateral movement of the first floor panel relative to the second floor panel.

The top surface may have a raised tread for traction.

The top surface and the bottom surface may define a plurality of drainage bores extending through the body. The top surface and the bottom surface may define a spike-retaining bore extending through the body. The spike-retaining bore may have an internal diameter of about 1.8 cm to about 2.5 cm. The spike-retaining bore may include an internal surface defining a cutout portion. The spike-retaining bore may be surrounded by an inset edge portion of the top surface and a projecting edge portion of the bottom surface, wherein the inset edge portion is adapted to receive a corresponding projecting edge portion of the second floor panel when the second floor panel is stacked on the top surface of the first floor panel for reducing lateral movement of the first floor panel relative to the second floor panel.

The cable-retaining lip may be adapted to overhang the segment of the contiguous channel so as to at least partially define a gap relative to a closest edge of the second floor panel that is less than 10 mm across.

The body of the first floor panel may be integrally formed.

In another aspect, the present invention also provides a modular flooring system comprising a plurality of interconnectable floor panels which includes the first floor panel.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

The invention will now be described in greater detail with reference to the accompanying drawings, in which:

FIG. 2 also shows (H) top perspective and (I) bottom perspective views, respectively, of an alternative embodiment of the present invention.

FIG. 3 also shows (E) a bottom plan view of an array of four floor panels according to the embodiment shown in FIGS. 2H and 2I.

DETAILED DESCRIPTION

Figure 1:
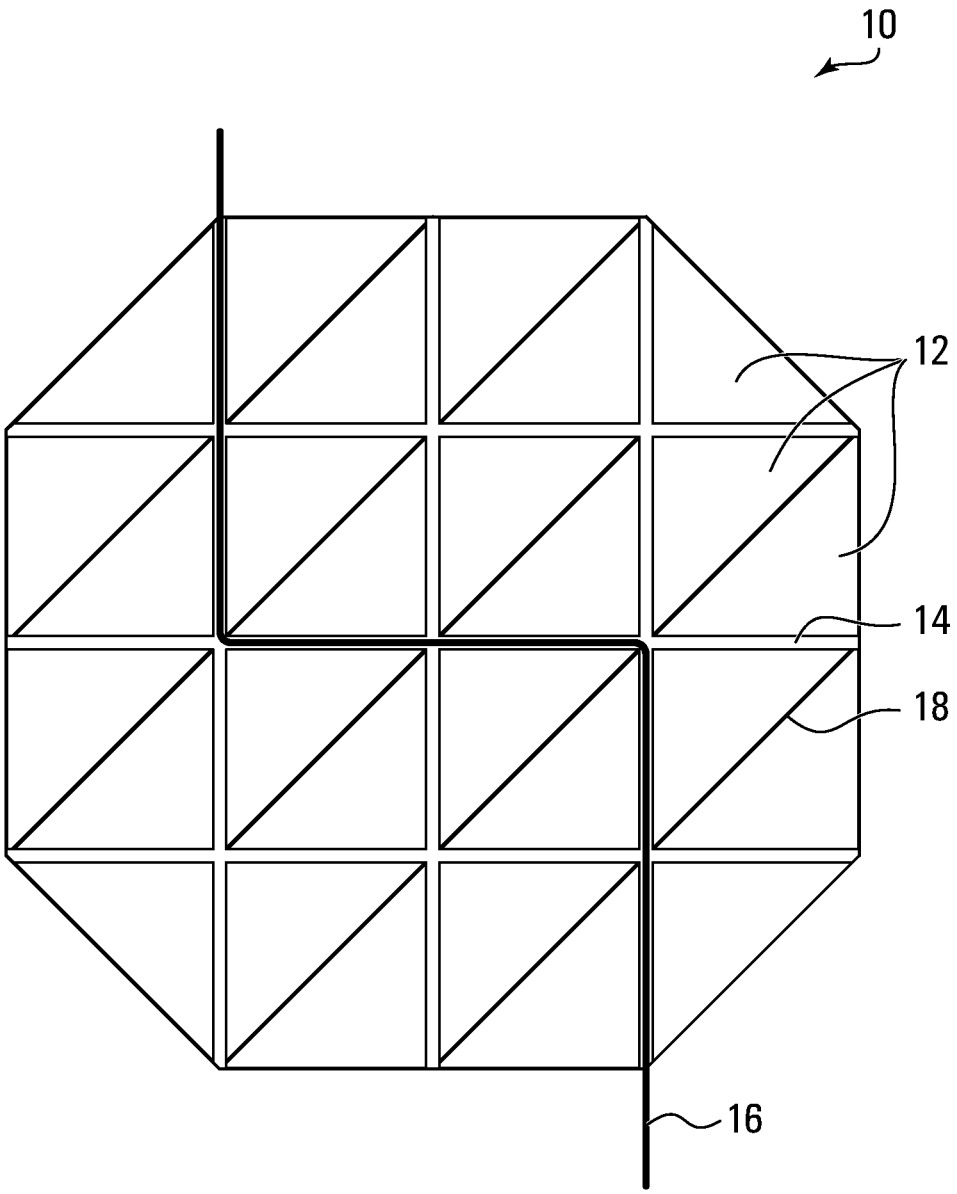
FIG. 1 shows an embodiment of the present invention in a top plan view, illustrating a cable housed within the contiguous channel formed between floor panels that are connected in an array.

Referring to FIG. 1, a modular flooring system according to an embodiment of the invention is shown generally at 10. The flooring system 10 includes repeating panel units 12 which together form an array throughout which a contiguous channel 14 is formed for retainably housing a cable 16 or multiple cables (not shown). Where the repeating panel unit 12 is a single floor panel (shown), segments of the contiguous channel 14 are formed between panel units 12 where they connect. Depending on the types of connectors between panel units 12, connecting panel units 12 may form a segment of the contiguous channel 14 or may form a non-channel-forming connection 18. In some embodiments, for example where the repeating panel unit consists of more than one floor panel (not shown), segments of the contiguous channel may be formed through, between or through and between repeating panel units. While the embodiment shown in FIG. 1 demonstrates a repeating panel unit 12 consisting of a single triangular floor panel assembled in pairs to form square panels presenting four channel-forming sides, the individual floor panels may be triangular, square, rectangular, trapezoidal, hexagonal, polygonal, or any other suitable shape. The connecting sides may be generally straight, curved or irregular. All of the connecting sides may be channel-forming (not shown) or less than all of the connecting sides may be channel-forming (shown). The repeating panel unit may include a single floor panel (e.g. panel unit 12) or may include multiple floor panels (not shown).

Figure 2A:
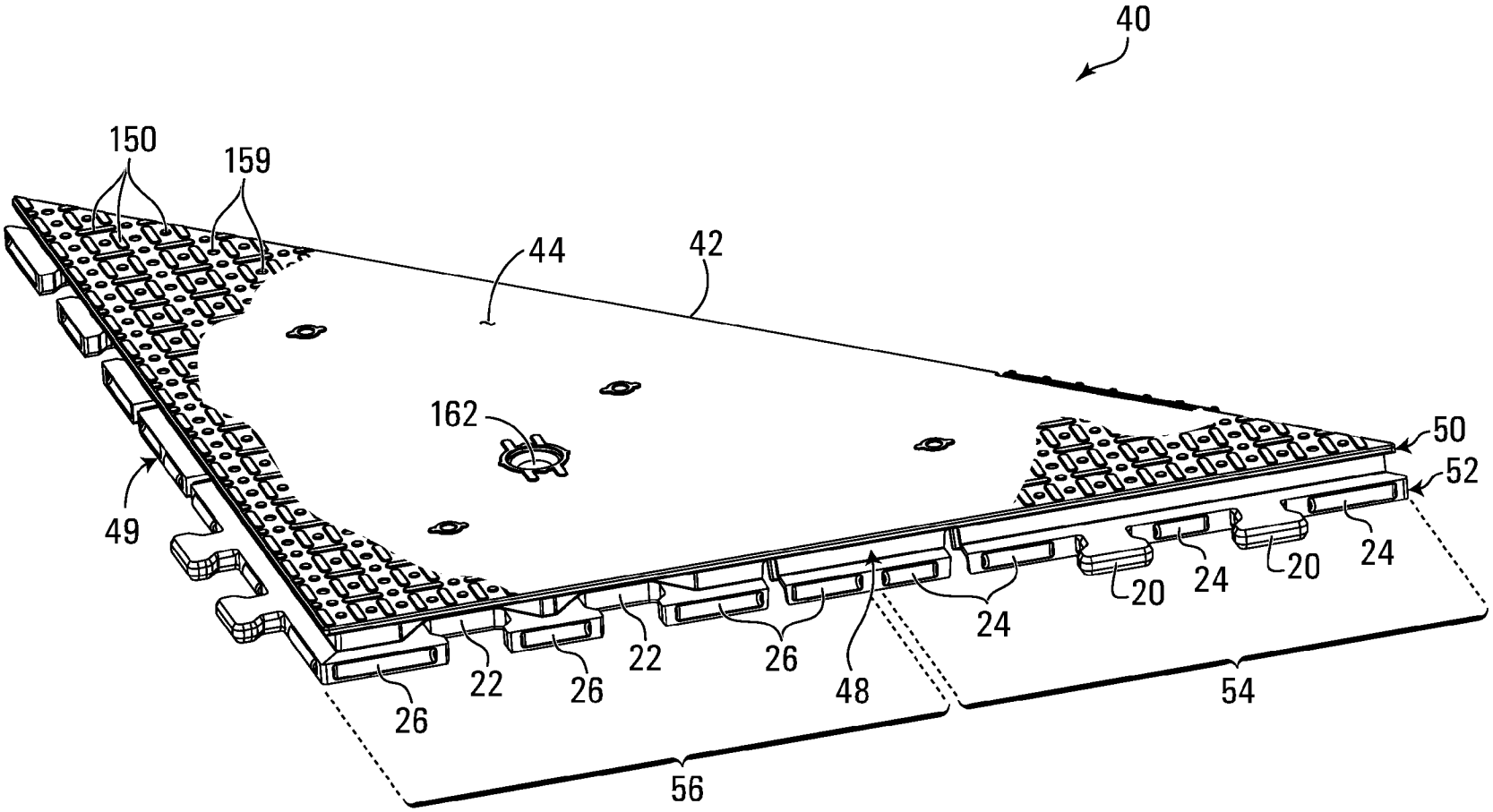
FIG. 2 shows (A) top perspective, (B) bottom perspective, (C) top plan, (D) first side elevation, (E) second side elevation, (F) third side elevation, and (G) bottom plan views, respectively, of a floor panel accordingly to an embodiment of the present invention. For clarity, a portion of the raised tread and drainage bores is not shown in (A).
Figure 2B:
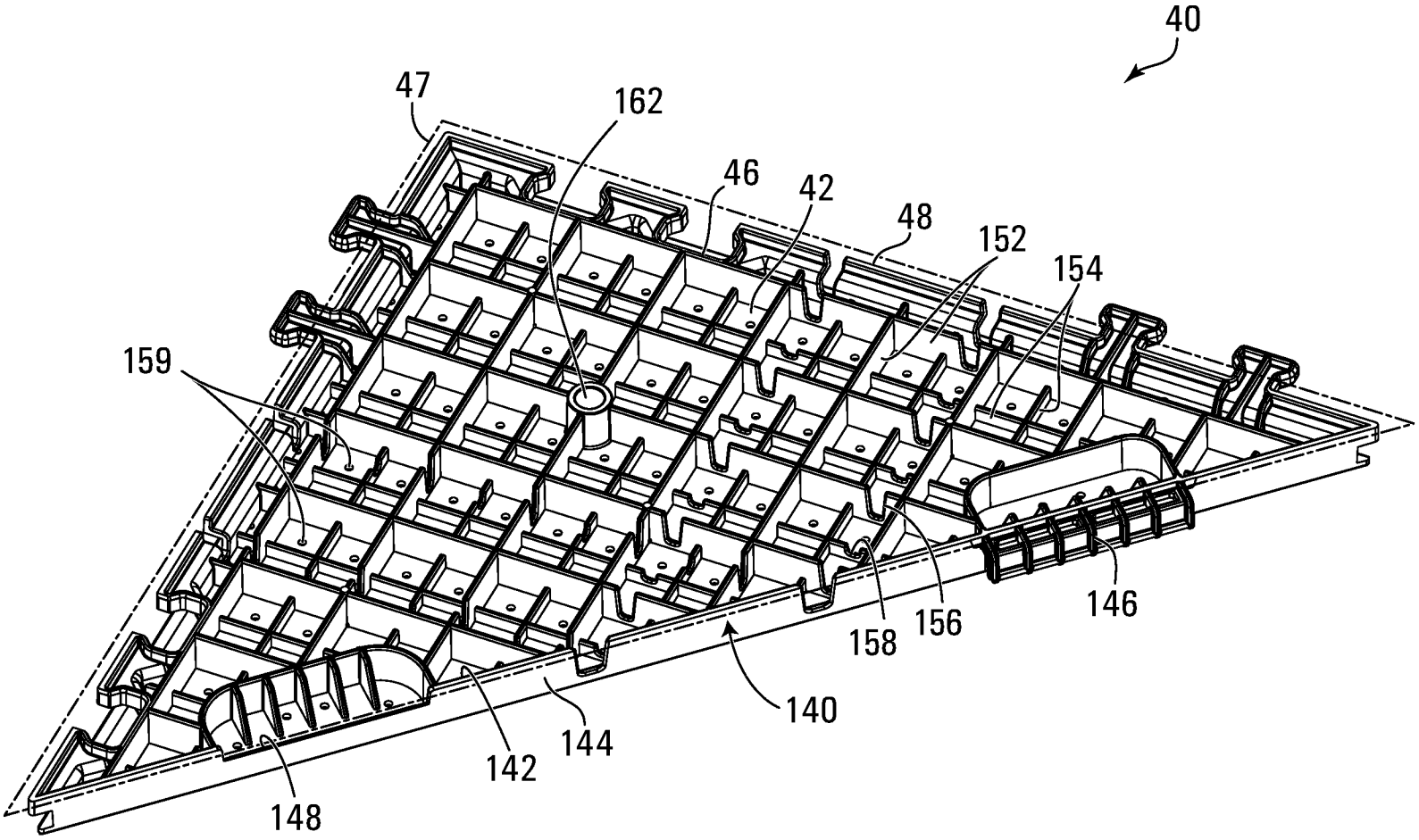
Figure 2F:
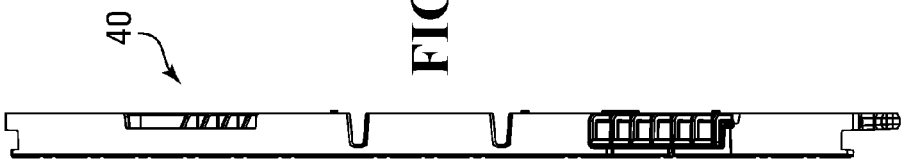
Figure 2C:
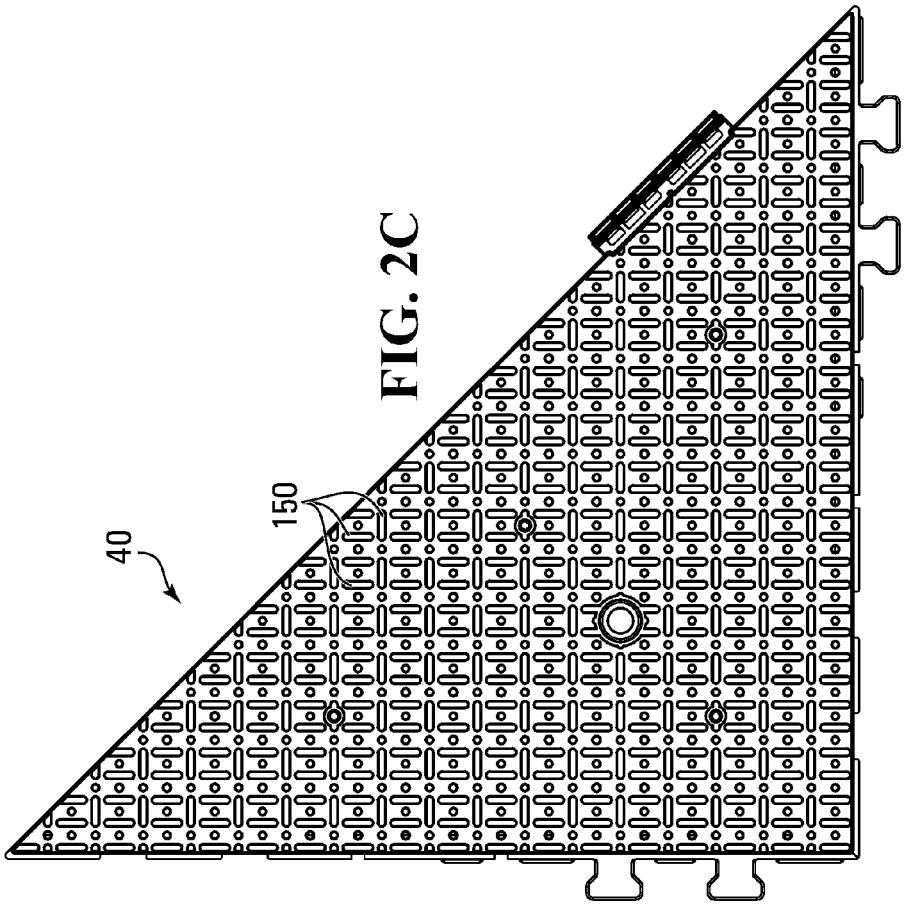
Figure 2D:
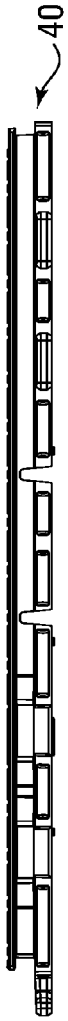
Figure 2E:
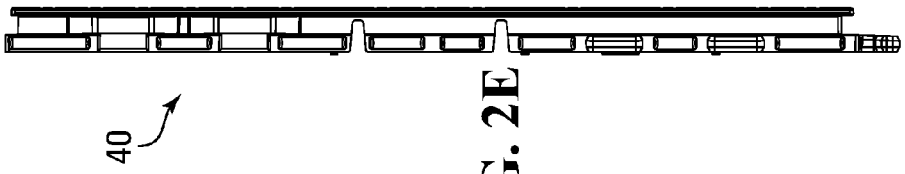

Referring to FIGS. 2A to 2G, a first floor panel according to an embodiment of the invention is shown generally at 40. The first floor panel 40 includes a body 42 having a generally planar top surface 44 (FIGS. 2A and 2C), a bottom surface 46 (FIGS. 2B and 2G) defining a bottom plane 47, and a first side 48 (FIGS. 2A and 2D). The first side 48 includes a cable-retaining lip 50 proximal to the top surface 44 and an interlocking support 52 proximal to the bottom plane 47 of the bottom surface 46.

The body 42 may or may not be integrally formed. For example, the body 42 may be produced by high pressure injection moulding processes or other suitable means.

The body 42 may be composed of a base polyolefin thermoplastic, optionally containing additives. For example, the base polyolefin thermoplastic may contain an additive for superior impact resistance over a wide range of temperatures (e.g. resistant over an operating ambient temperature range of −51° C. to +49° C. as per ASTM D256-10 Standard Test Methods for Determining the Izod Pendulum Impact Resistance of Plastics), a non-halogen fire retardant additive (e.g. as per ULC/CAN S102.2-10 standard), an anti-static additive (e.g. as per ANSI/ESD S 7.1-2005 standard within the range of 10E6 to 10E9 ohms of resistance), a UV resistance additive (e.g. for 10 year minimum performance as per ASTM D2565-99 (2008) Standard Practice for Xenon-Arc Exposure of Plastics Intended for Outdoor Applications standard), a static load resistance additive of a minimum of 3.5 MPa, a waterproofing additive, an antimicrobial additive, or a combination of any of the above additives.

The dimensions of the floor panels may be any suitable dimensions. For example, the first floor panel 40 may form a right angle triangle (as shown in FIG. 2) having a first side 48 and a second side 49 (FIGS. 2A and 2E) equal to the first side 48. Each of the first side 48 and the second side 49 may be about 70.0 cm to about 110.0 cm across the lateral (i.e. horizontal) plane, for example. In the transverse (i.e. vertical) plane, perpendicular to the lateral plane, the first floor panel 40 may be from about 3.0 cm to about 6.0 cm, for example.

Figure 3A:
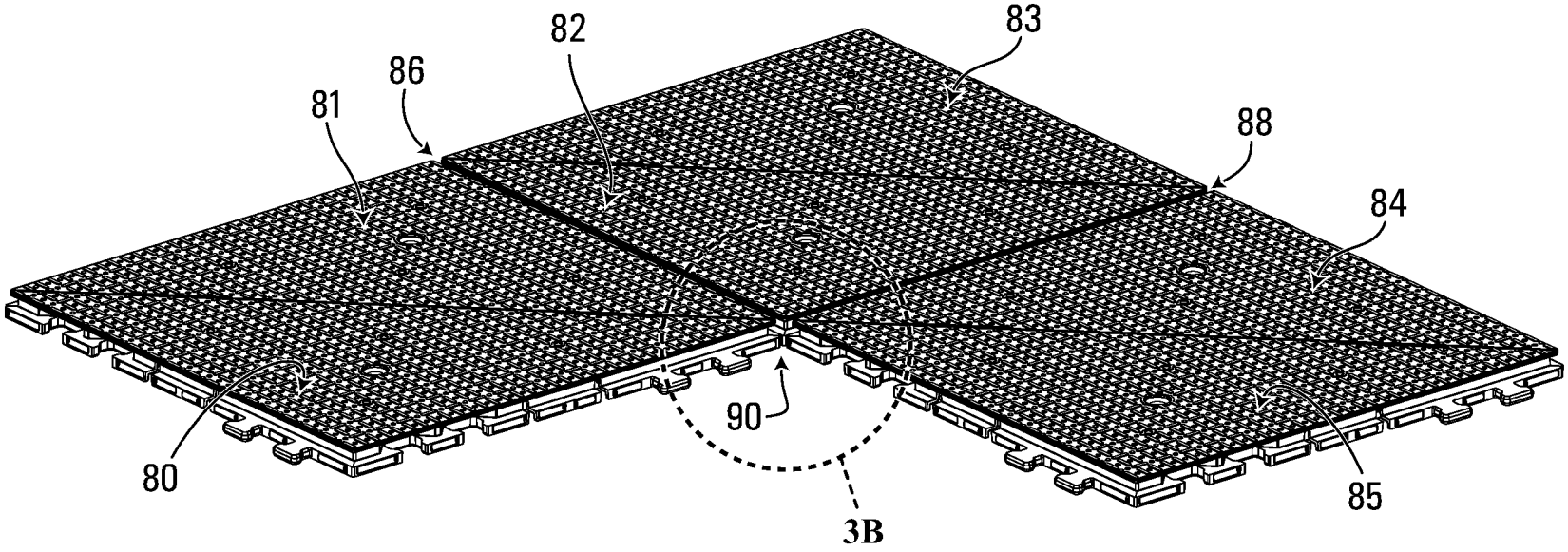
FIG. 3 shows six floor panels according to the embodiment shown in FIGS. 2A to 2G, connected in an array, in (A) top and (C) bottom perspective views, respectively.
FIG. 3(B) shows a close-up view in detail of the portion indicated in (A) and FIG. 3(D) shows a close-up view in detail of the portion indicated in (C).
Figure 3B:
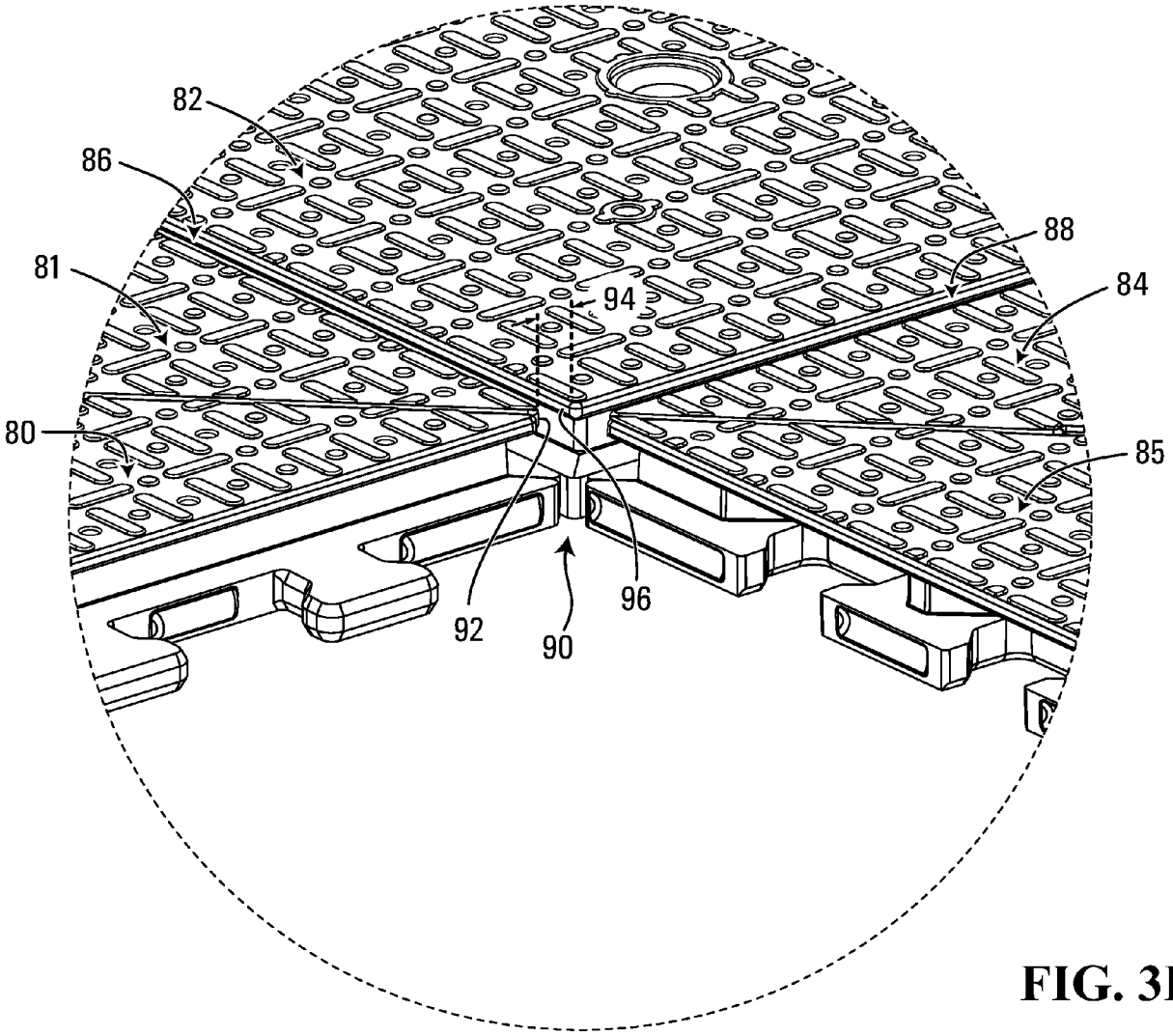
Figure 3C:
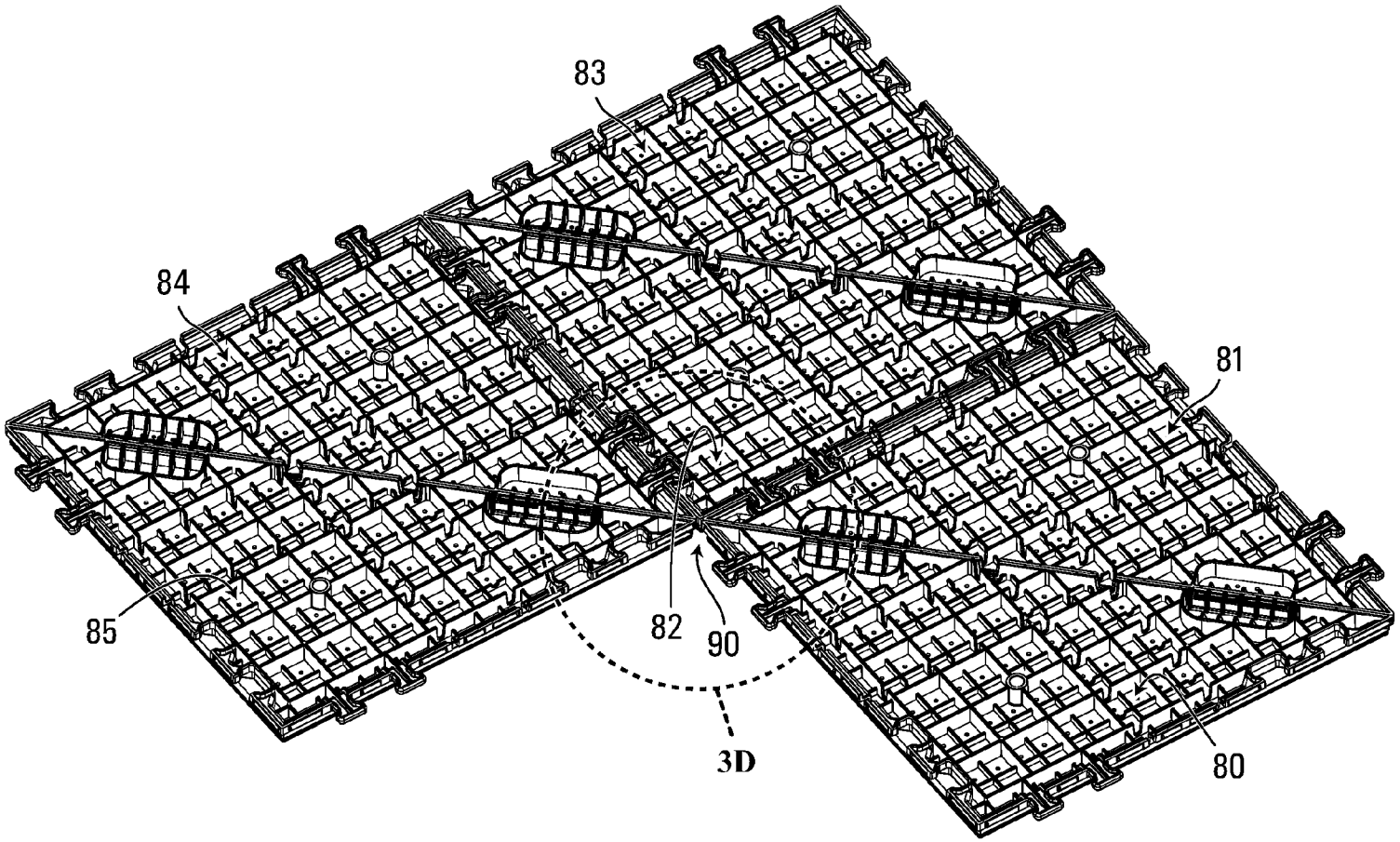
Figure 3D:
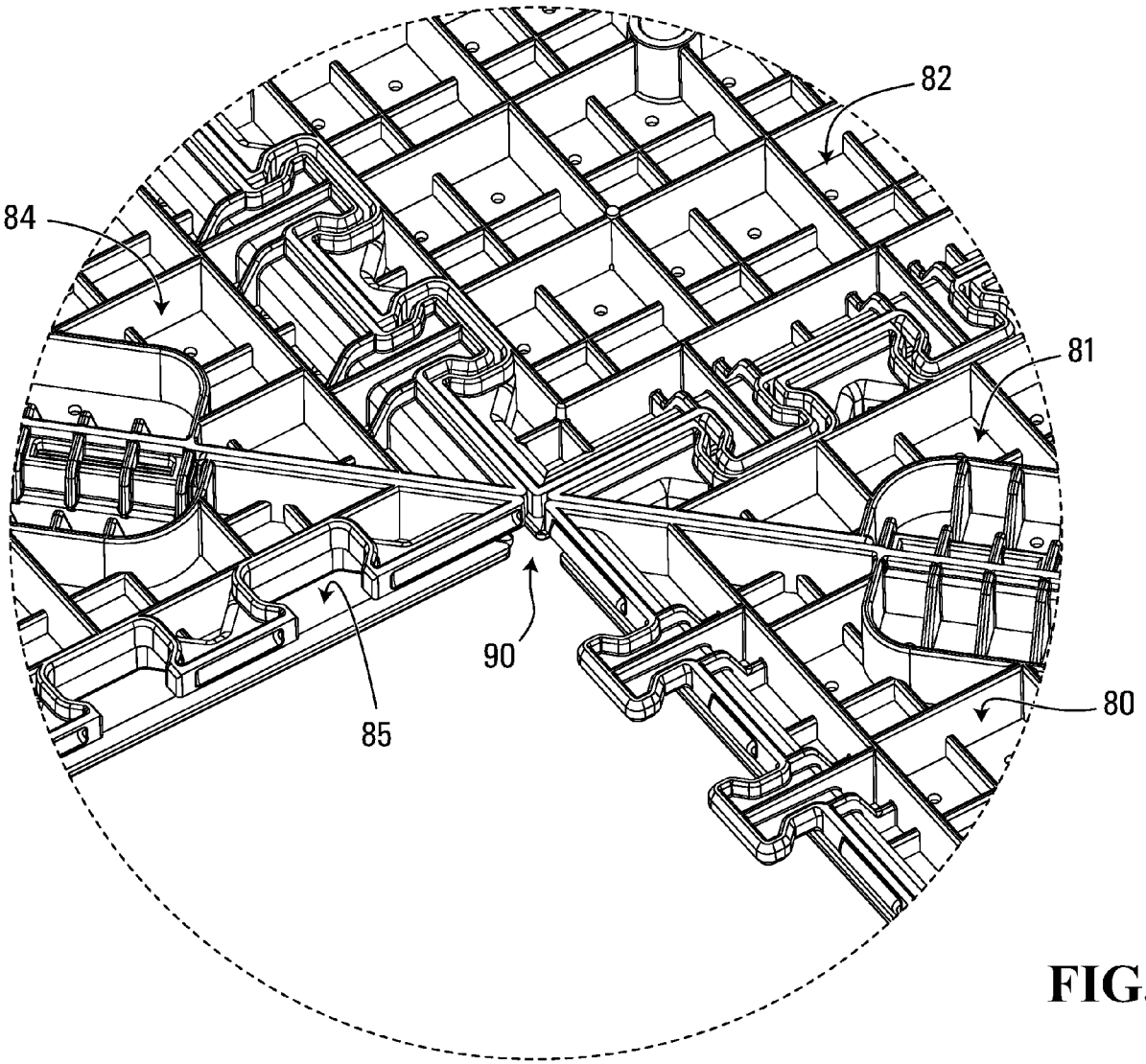
Figure 4A:
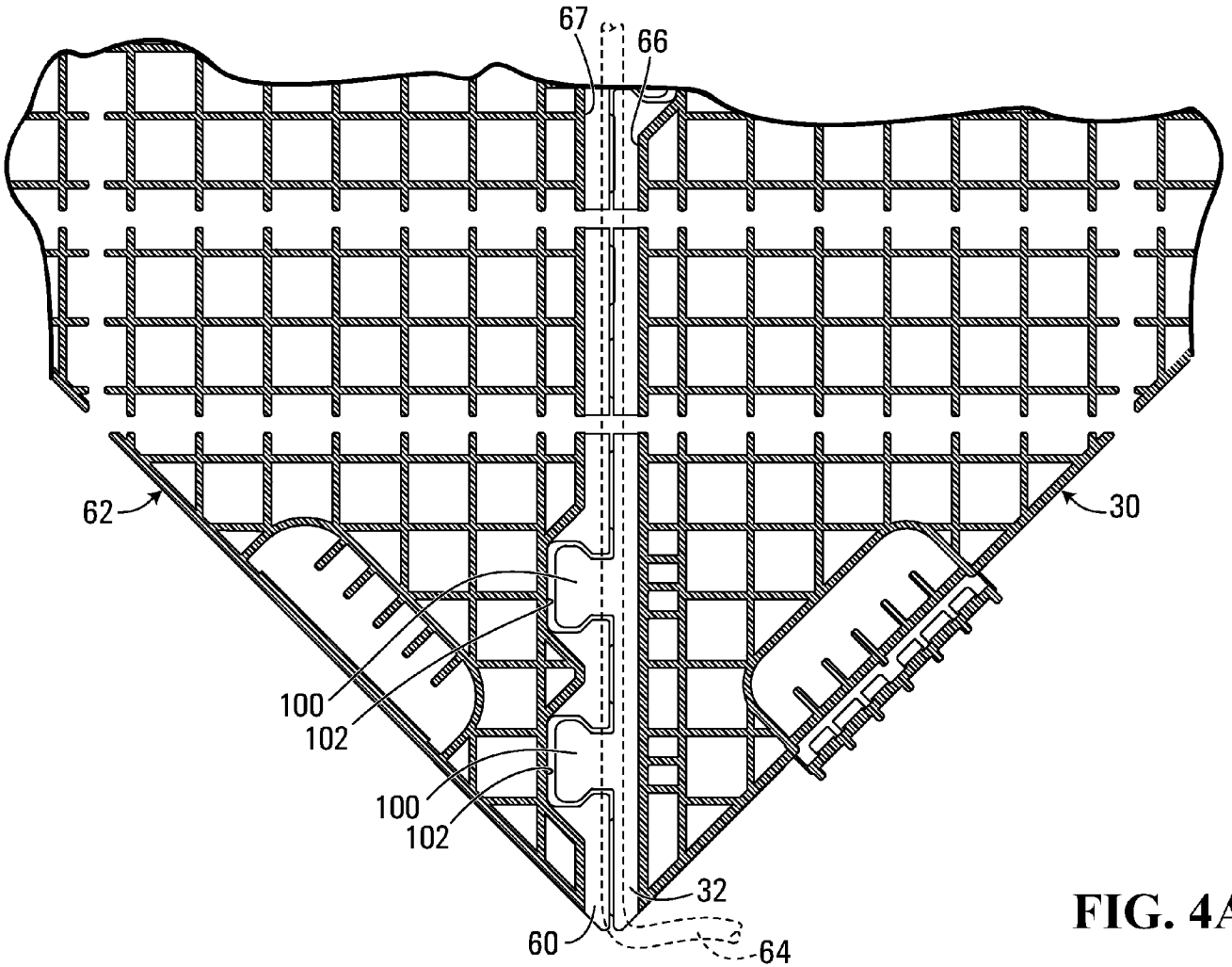
FIG. 4 shows a laterally cross-sectioned portion of two connected floor panels according to the embodiment shown in FIGS. 2A to 2G in a top plan view, indicating (A) a path for a cable, (B) the seated position, and (C) the unseated position.
Figure 4B:
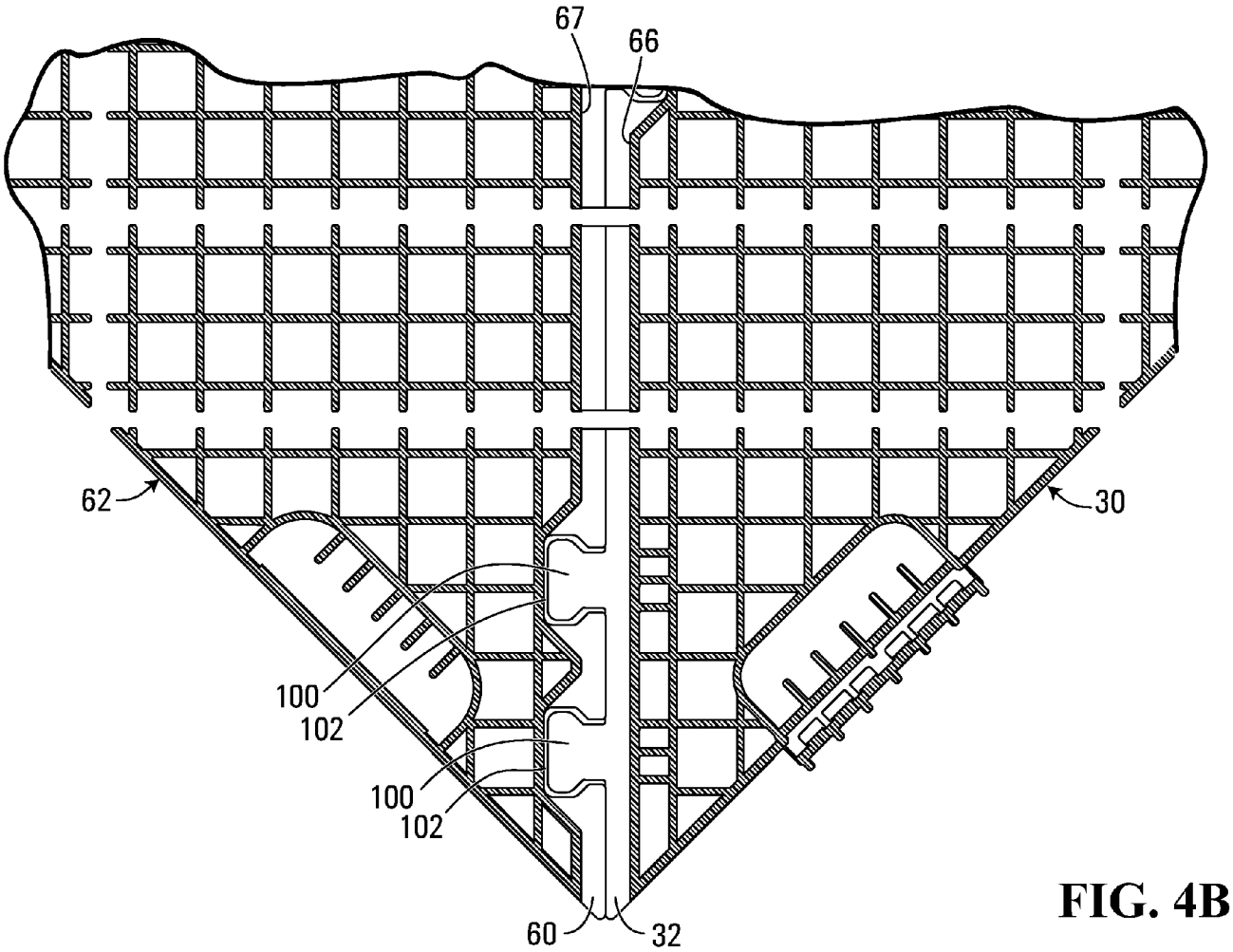
Figure 4C:
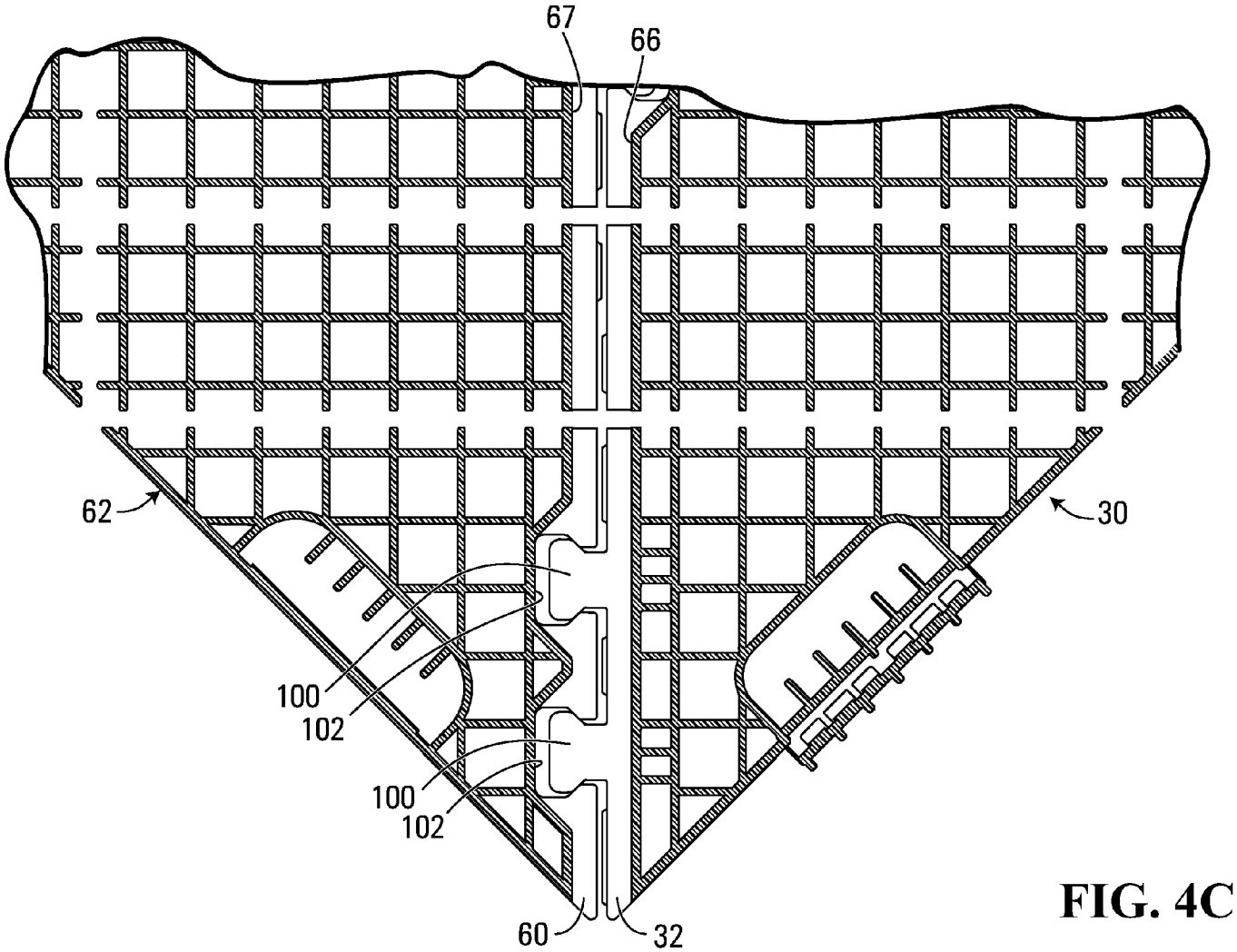

An array of six floor panels 80-85 is shown in FIGS. 3A to 3D and a close-up sectional view of two connected floor panels 30 and 62 is shown in FIG. 4. Referring now to FIG. 4, interlocking support 32 of floor panel 30 is shaped to interlock with the interlocking support 60 of floor panel 62 to form a segment of the contiguous channel indicated in FIG. 4 by the stippled cable 64 lying thereon. The size of the channel segment so indicated is dependent on the dimensions of its corresponding floor panels, e.g. the distance between the innermost surfaces 66 and 67 of the respective sides from which the interlocking supports 32 and 60 respectively extend. For example, each channel segment may be wide enough to accommodate eight or more CAT-sized cables under a top plane defined by the top surface 44 (shown in FIGS. 2A and 2C). As indicated in FIG. 4A, the channel formed by interlocking supports 32 and 60 is adapted to retainably house cable 64, spaced apart from the bottom plane 47 defined by the bottom surface 46 (see FIG. 2B).

Now referring to FIGS. 3A to 3D, six floor panels 80-85 are shown interlocked in an array. In the arrangement shown, channel segments 86 and 88 are formed between floor panels 81 and 82 and between floor panels 82 and 84, respectively. Channel segments 86 and 88 meet at junction 90 such that in a larger array, a contiguous channel is formed (see FIG. 1) which includes multiple perpendicular internal sub floor cable runs providing a cable-management system.

Referring to FIG. 3B, in particular, the cable-retaining lip 92 of floor panel 81 may be adapted to overhang its corresponding channel segment 86 so as to at least partially define a gap 94 between cable-retaining lip 92 and opposing cable-retaining lip 96. For example, the gap 94 may be wide enough to accommodate most standard cable diameters but narrow enough so that standard wheeled chairs, carts and gurneys and chair legs will not penetrate the gap 94. For example, the gap 94 may be less than 10 mm across and larger than 6 mm across. The gap 94 may be about 8 mm across. Accordingly, the cable-retaining lips 92 and 96 protect any cable(s) (not shown) retainably housed within the channel segment 86 from damage and reduce tripping hazards created from loose cables sticking up above the gap 94. The cable retaining lips 92 and 96 need not have a flat edge as shown in FIG. 3B, but may be curved, irregular, digitated or have any other shape suitable for retaining at least a portion of a cable.

Referring to FIG. 4A, the interlocking support 32 of floor panel 30 may be shaped to interlock with the interlocking support 60 of the floor panel 62 such that movement of the floor panel 30 relative to floor panel 62 is restricted along a lateral (i.e. horizontal) plane. For example, interlocking support 32 may include one or more generally T-shaped projections 100 which each extend and widen along the lateral plane. As shown for the corresponding interlocking support 60 of floor panel 62, an interlocking support may include one or more generally T-shaped retainers 102 which are respectively shaped and disposed for retaining the generally T-shaped projections 100 of floor panel 30. The generally T-shaped projections may have bevelled edges (as shown in FIG. 2A for generally T-shaped projections 20).

Figure 5:
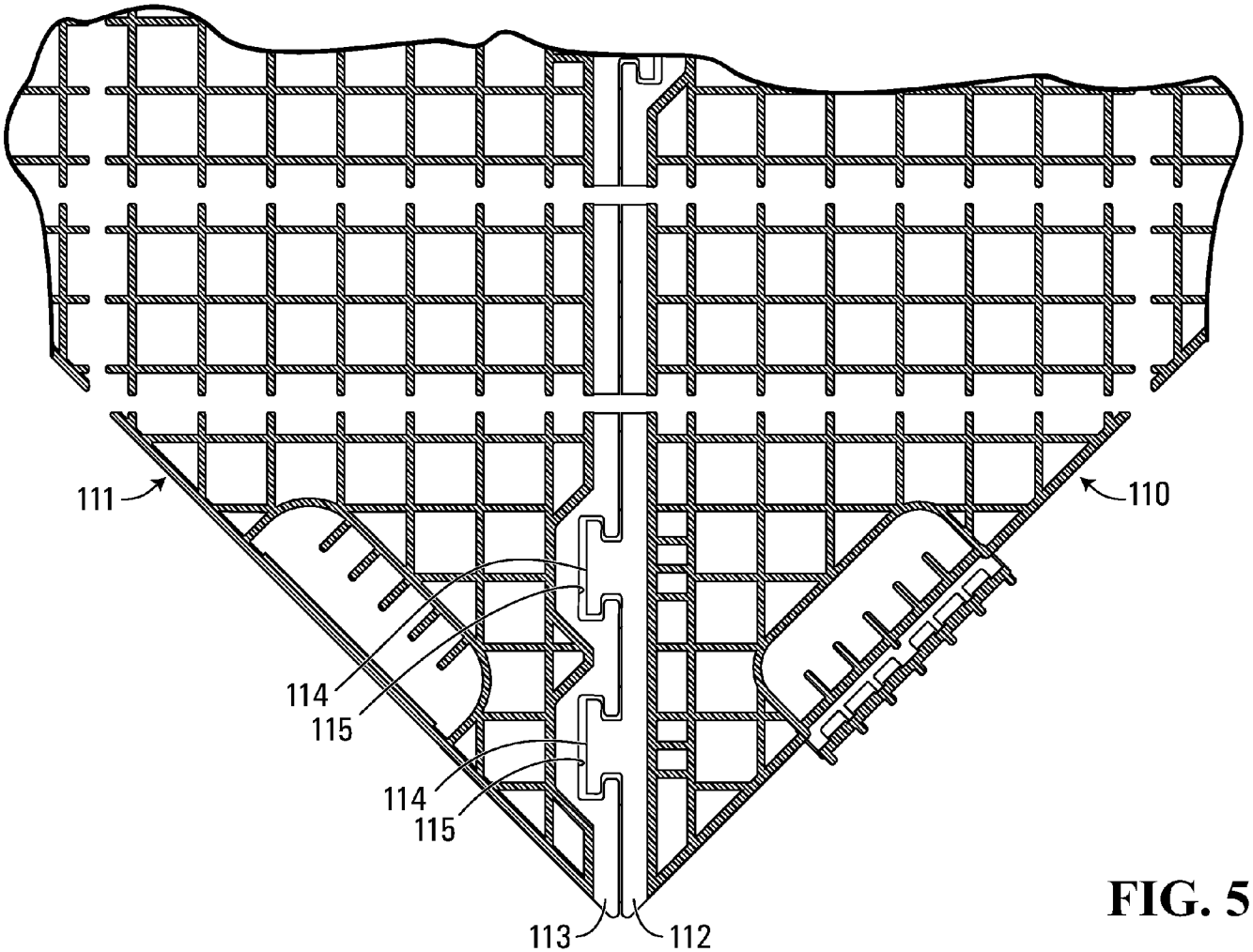
FIG. 5 shows a laterally cross-sectioned portion of two connected floor panels according to another embodiment of the present invention, shown in a top plan view.

FIG. 5 shows a variant of the present invention. Interlocking floor panels 110 and 111 have interlocking supports 112 and 113, respectively. Interlocking support 112 has generally T-shaped projections 114, distinctly shaped from the generally T-shaped projections 100 shown in FIG. 4A, and interlocking support 113 has generally T-shaped retainers 115, distinctly shaped from the generally T-shaped projections 102 shown in FIG. 4A, but respectively shaped and disposed for retaining the generally T-shaped projections 114.

As shown in FIG. 2A, a single floor panel may include both generally T-shaped projections 20 and generally T-shaped retainers 22 disposed on the same side 48. While the embodiments shown in FIGS. 1 to 7 show each floor panel having both generally T-shaped projections and retainers, corresponding floor panels of a repeating panel unit may include a plurality of generally T-shaped projections without any retainers, or a plurality of generally T-shaped retainers without any projections. These embodiments would then require at least two floor panels to form a repeating panel unit.

Referring again to FIG. 4, interlocking support 32 may be shaped to interlock with the corresponding interlocking support 60 of the floor panel 62 such that movement of the floor panel 30 relative to floor panel 62 is restricted along the transverse (i.e. vertical) plane. For example, the interlocking support 32 may be shaped to interlock with the corresponding interlocking support 60 of the floor panel 62 such that the floor panel 30 is movable relative to floor panel 62 along the lateral (i.e. horizontal) plane between a seated position (shown in FIG. 4B) and an unseated position (shown in FIG. 4C), and such that transverse (i.e. vertical) movement of floor panel 30 relative to floor panel 62 is restricted in the seated position but not restricted in the unseated position.

Referring now to FIG. 2A, interlocking support 52 may further include an interlocking surface defining a first portion 54 (shown to the right) and a second portion 56 (shown to the left) juxtaposed along the lateral plane with first and second generally T-shaped projections 20 spaced apart on the first portion and first and second generally T-shaped retainers 22 spaced apart on the second portion. According to this embodiment, interlocking support 52 of the first floor panel 40 is connectable with a corresponding interlocking support of a second floor panel (as shown in FIG. 3A with respect to panels 81 and 82, for example) by pivoting one of the two panels relative to the other about a common laterally aligned axis centered on the interlocking supports.

The interlocking surface may include either or both of curved projections 24 extending outward from first side 48 and curved recesses 26 shaped and disposed to receive corresponding curved projections of a second floor panel (not shown) corresponding to the curved projections 24 of the first floor panel 40. As shown in FIG. 2A, the curved projections 24 may be disposed on the first portion 54 and the curved recesses 26 may be disposed on the second portion 56, however, the curved projections 24 and curved recesses 26 may be disposed in any suitable manner.

Figure 2G:
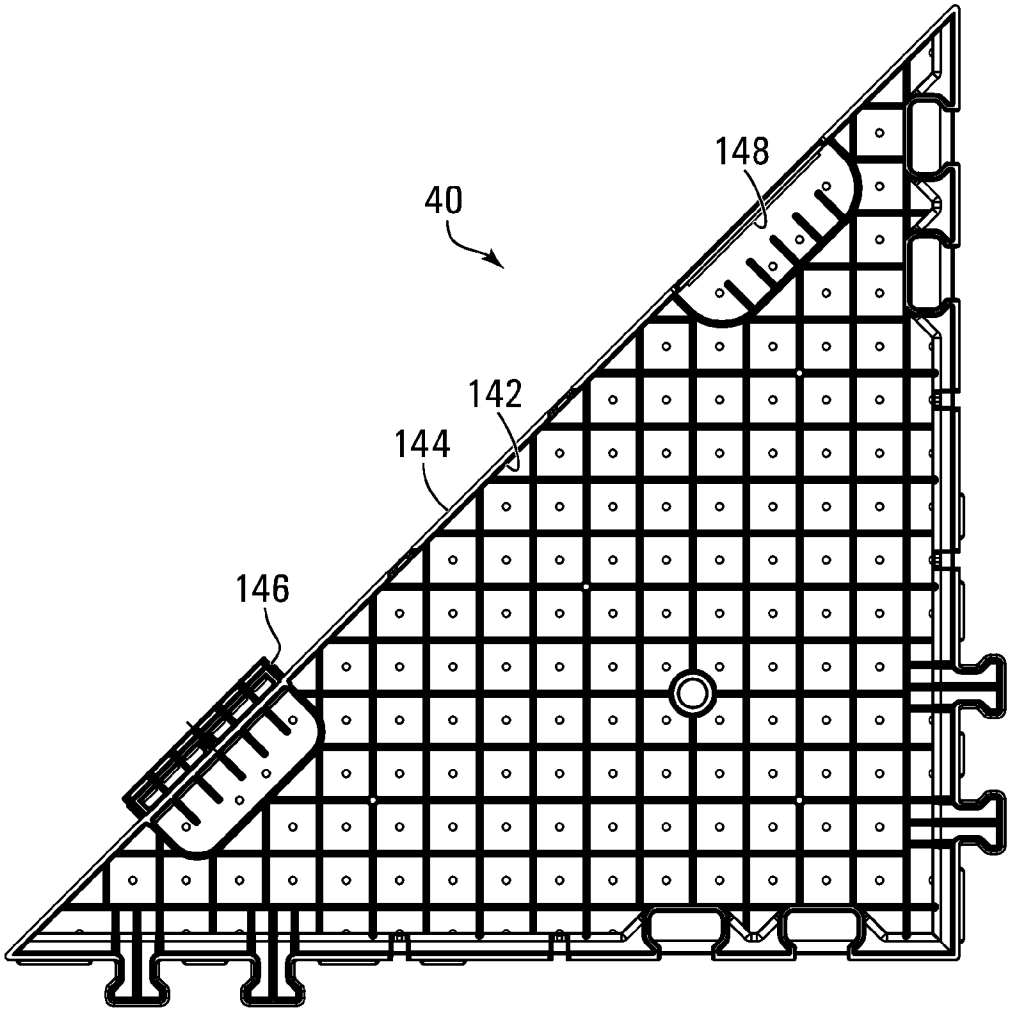
Figure 2H:
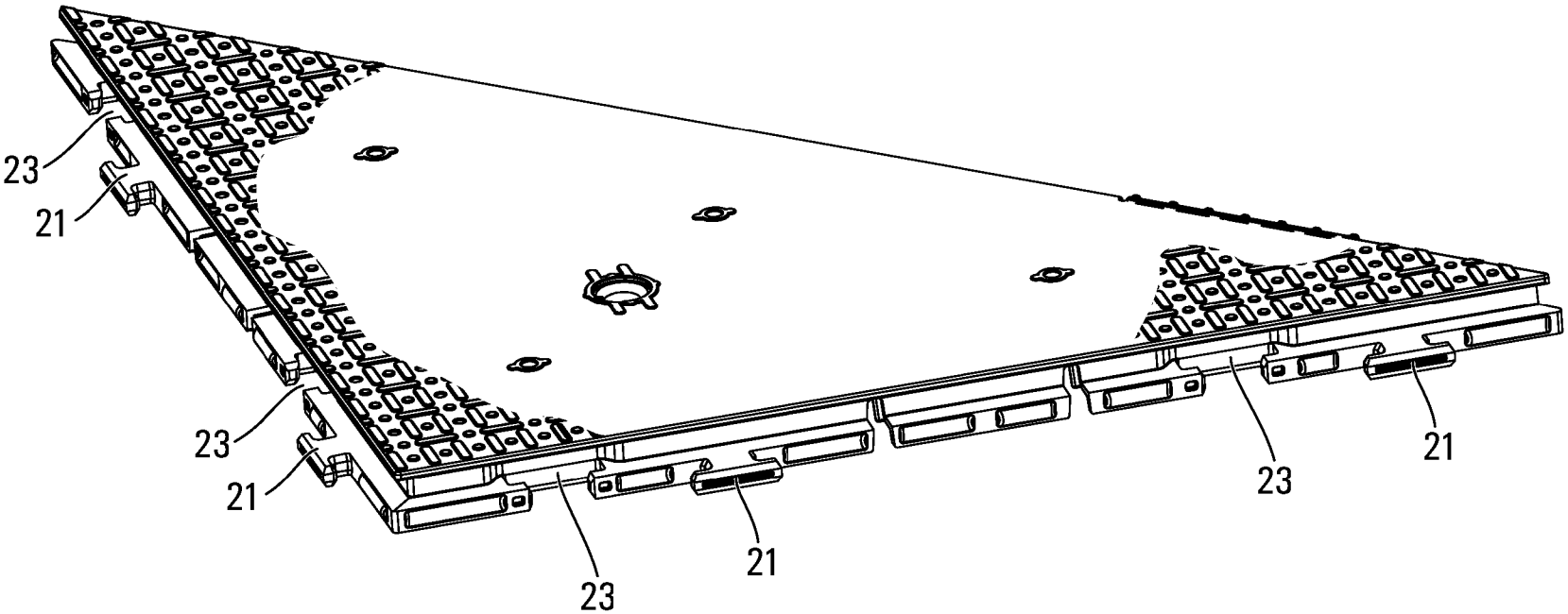
Figure 2I:
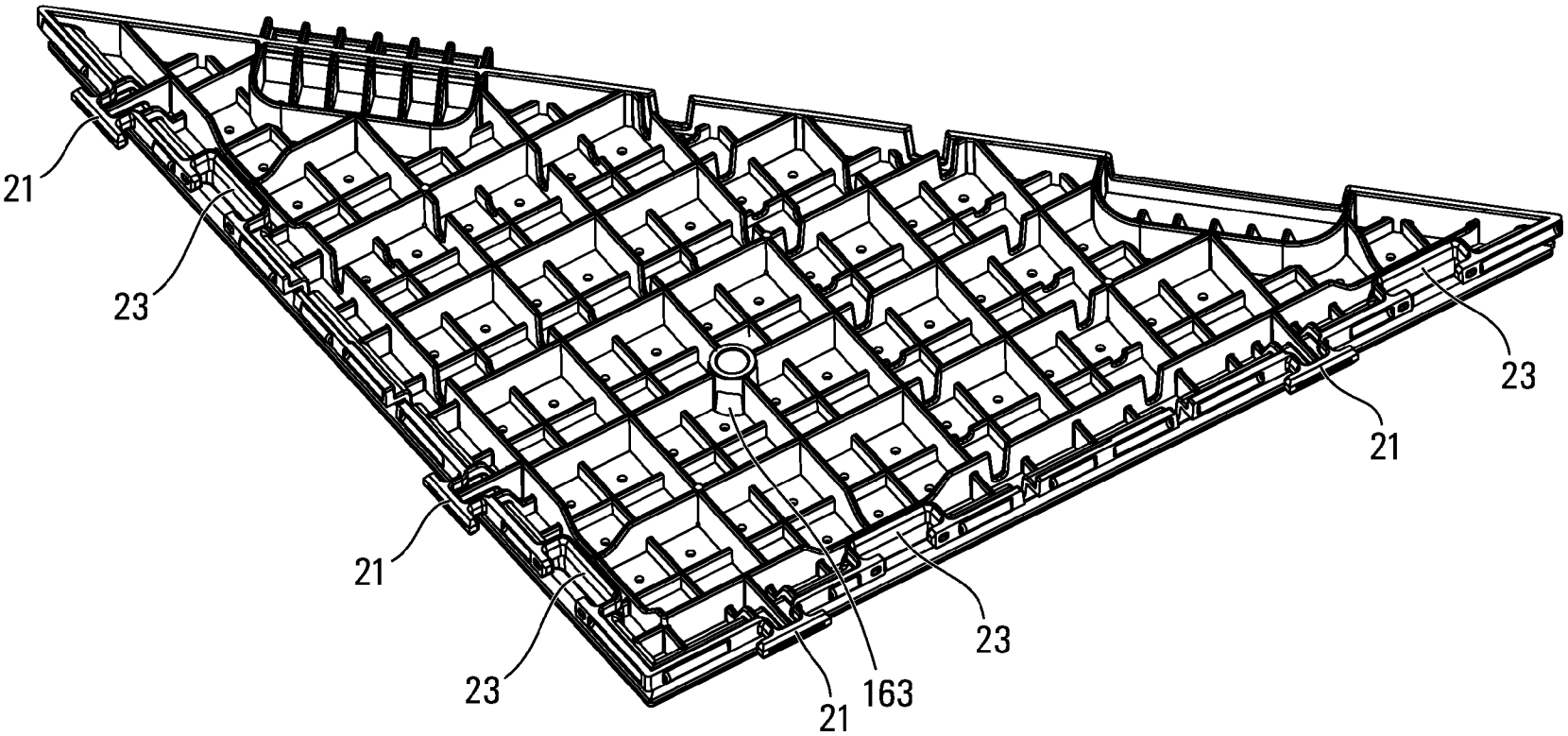
Figure 3E:
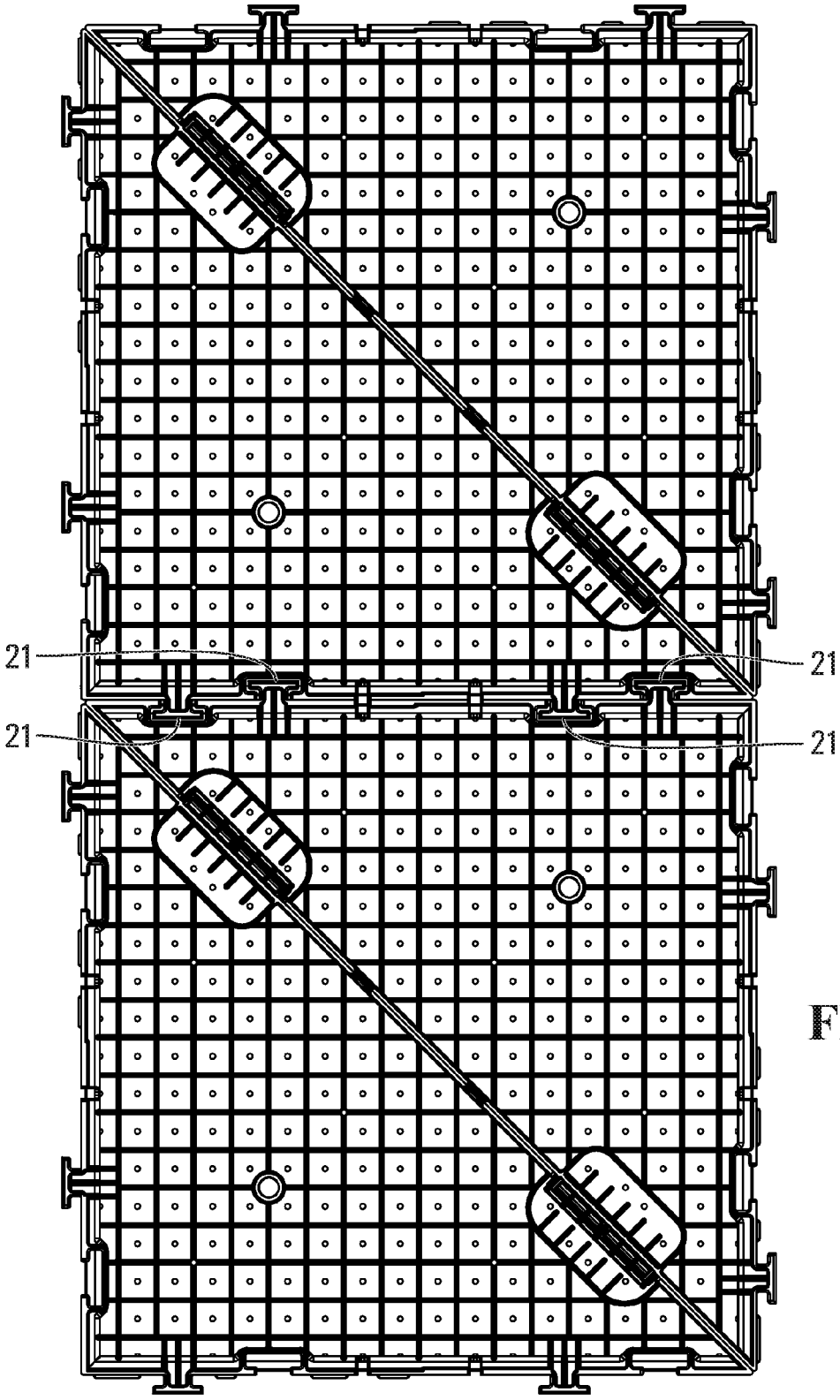

An alternative configuration of generally T-shaped projections 21 and generally T-shaped retainers 23 is shown in FIGS. 2H and 2I, which assemble into an array as shown in FIG. 3E.

Figure 6A:
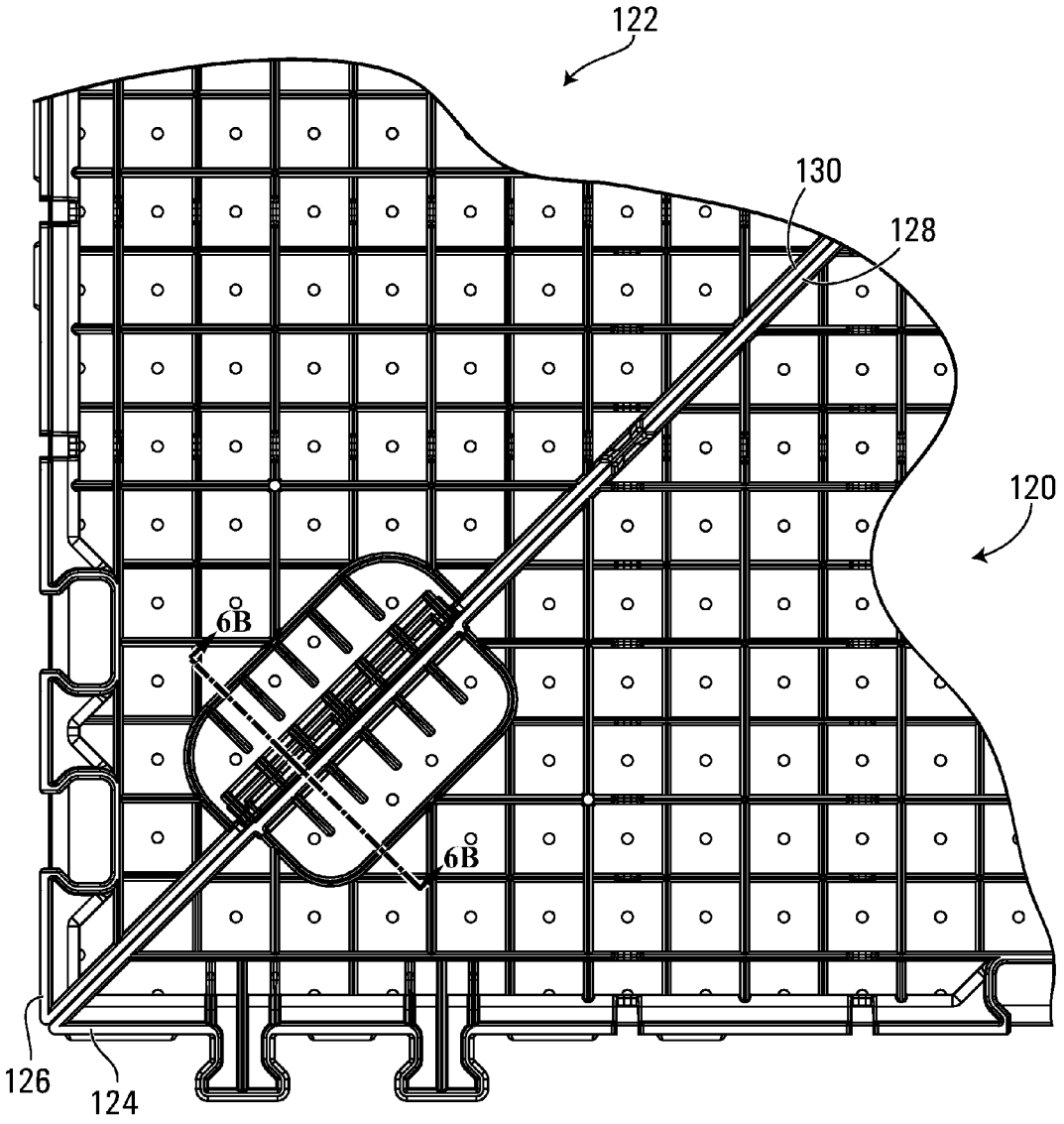
FIG. 6 shows two connected floor panels according to the embodiment shown in FIGS. 2A to 2G in (A) a bottom plan view and (B) a cross-sectional view in detail of the portion indicated by the section lines in (A).
Figure 6B:
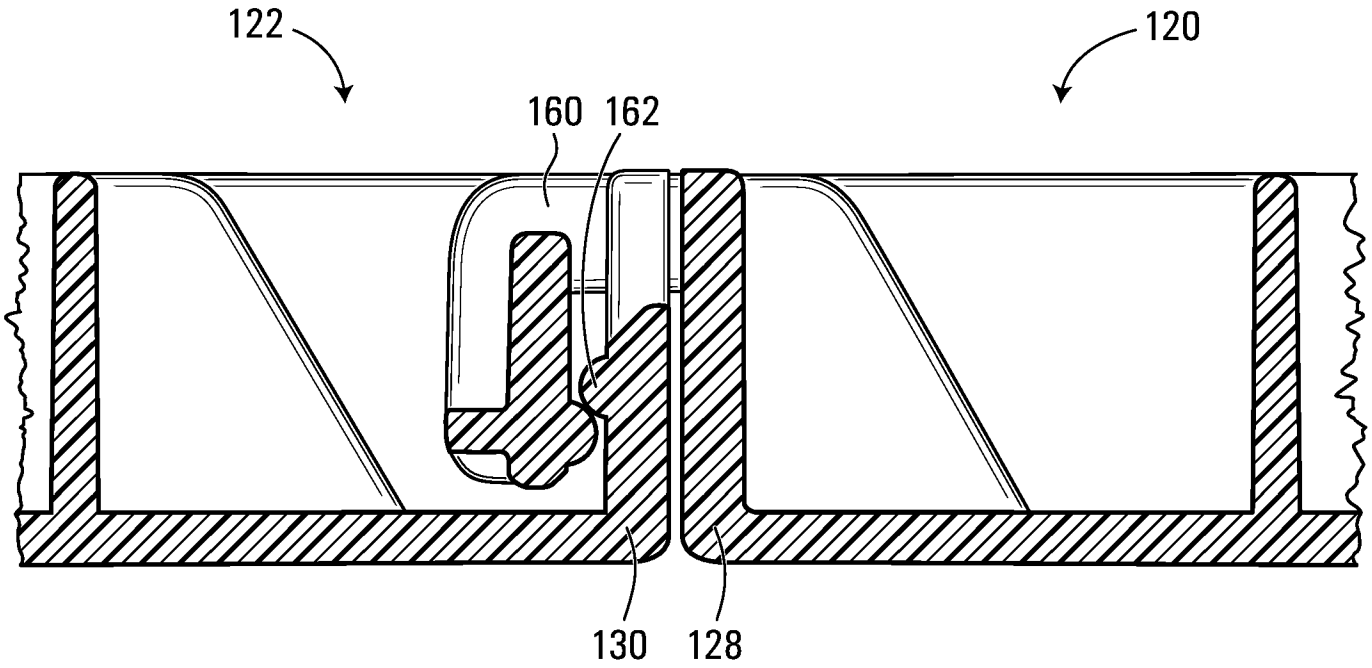

Referring to FIG. 6, a first panel 120 and a second panel 122 are shown having channel-forming sides 124 and 126, respectively. As shown, the first and second panels 120 and 122 may each have a non-channel-forming side 128 and 130, respectively. For example, the first floor panel 120 may have a first (channel-forming) side 124 and a second (channel-forming) side (not shown) such that the non-channel-forming side 128 defines the hypotenuse of an isosceles right triangle defined by all three sides combined. Where the second panel 122 also defines an isosceles right triangle, connecting together the non-channel-forming (i.e. hypotenusal) sides 128 and 130 forms a square floor panel.

Referring next to FIGS. 2B, 2F and 2G, floor panel 40 may have a non-channel-forming side 140 (a side elevation view of which is shown in FIG. 2F). The non-channel-forming side 140 may include an inner face 142, an outer face 144, a retainer 146 extending outward from outer face 144 proximal to the bottom plane 47 defined by the bottom surface 46, and a retainable member 148 formed between the inner face 142 and the outer face 144 and oriented towards the bottom plane 47. The retainer 146 defines a trench open towards the top surface 44 (best shown in FIG. 2B) that is shaped and disposed to retain a corresponding retainable member disposed on a second floor panel (not shown). For example, referring now to FIG. 6B, floor panel 120 has a retainer 160 adapted to retain retainable member 162 of floor panel 122. To connect floor panel 120 to floor panel 122, floor panel 120 is pivoted relative to floor panel 122 about a common laterally aligned axis centered on the non-channel-forming sides 128 and 130.

Now referring to FIGS. 2A and 2C, the top surface 44 may be generally smooth or may be irregular. For example, the top surface 44 may have a raised tread 150 for providing traction. The pattern of the tread 150 may provide traction from any walking direction.

Referring to FIG. 2B, the bottom surface 24 may include a number of deep support ribs 152 which extend from the undersurface of the body 42 to the ground beneath. The support ribs 152 may extend perpendicular to and parallel to a plane defined by the first side 48 or may be configured in any reasonable arrangement that supports the body 42. The bottom surface 46 may also include shallower structural ribs 154, disposed between the support ribs 152, which do not extend all the way to the ground. To accommodate uneven terrain, the support ribs 152 and the structural ribs 154 may include a number of cutout regions 156 and 158, which enhance flexibility of the body 42 in two perpendicular directions.

Referring to FIGS. 2A and 2B, the top surface 44 and the bottom surface 46 may define a plurality of drainage bores 159 extending through the body 42 of the first floor panel 40. Each drainage bore 159 may be radially tapered to further facilitate drainage. Where the top surface 44 includes a raised tread 150, the raised tread 150 may be adapted to maximize liquid drainage including sand and loose dirt and/or to exclude water traps.

The top surface 44 and the bottom surface 46 may define a spike-retaining bore 162 extending through the body 42 such that the first floor panel 40 can be anchored to the ground using a spike. The spike-retaining bore 162 may be sized to fit any particular diameter of spike. For example, the spike-retaining bore 162 may have an internal diameter of about 1.5 cm to about 2.5 cm or any other suitable diameter. The internal diameter of the spike retaining bore 162 may be adapted to allow for the spike to be driven through the spike retaining bore 162 at a predetermined angle from vertical.

Referring now to FIG. 2I, the internal surface of the bore may have a cutout portion 163 sized to receive the finger of a user. This helps the user hold on to the floor panel when a spike is not received in the spike-retaining bore and, for example, facilitates lifting the floor panel during disassembly of the array.

Figure 7A:
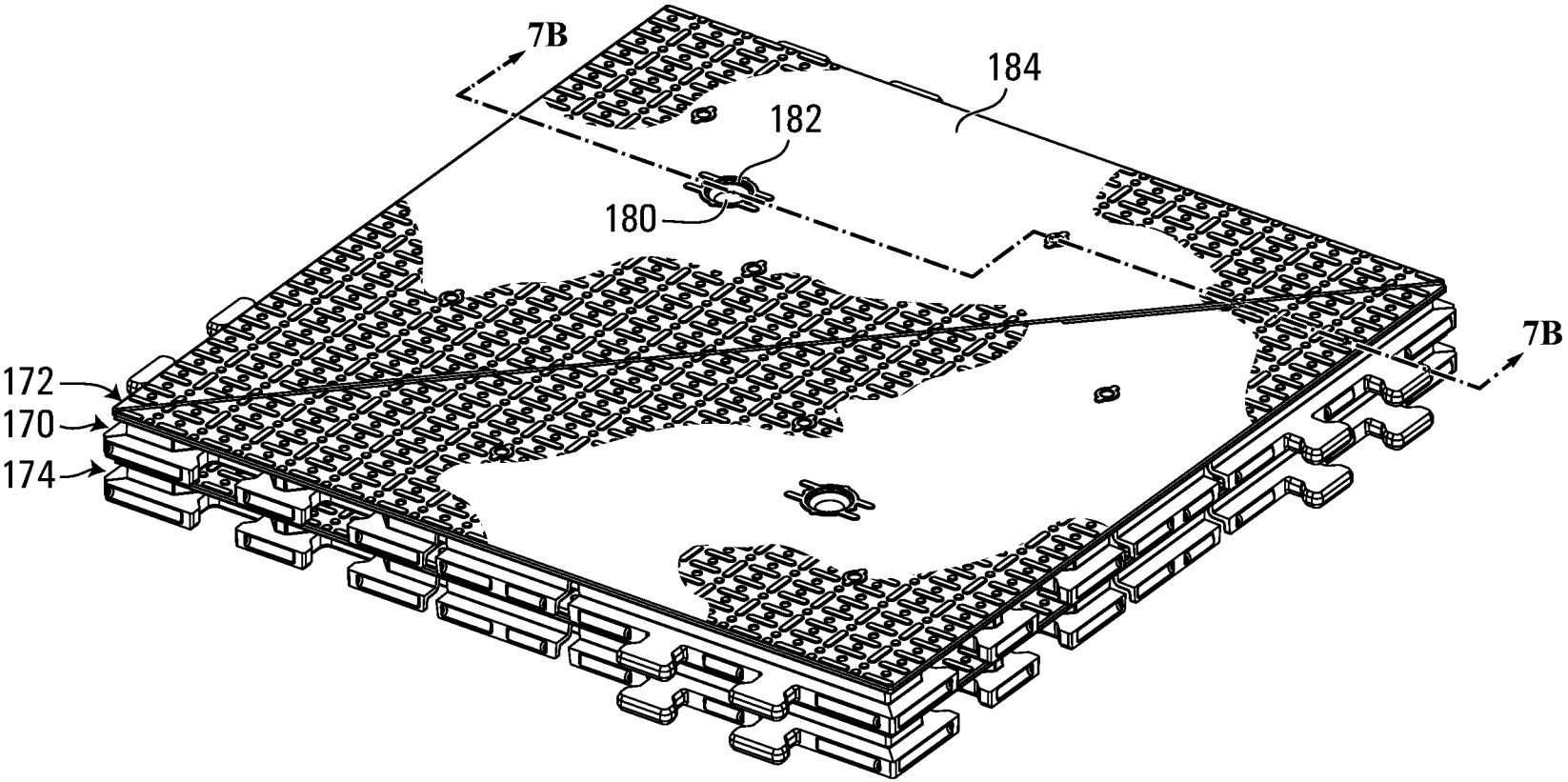
FIG. 7 shows four floor panels according to the embodiment shown in FIGS. 2A to 2G, with a first pair of connected floor panels stacked on top of a second pair of connected floor panels, in (A) a top perspective view, and (B) a sectional side-elevation view cross-sectioned along the section lines in (A).
Figure 7B:
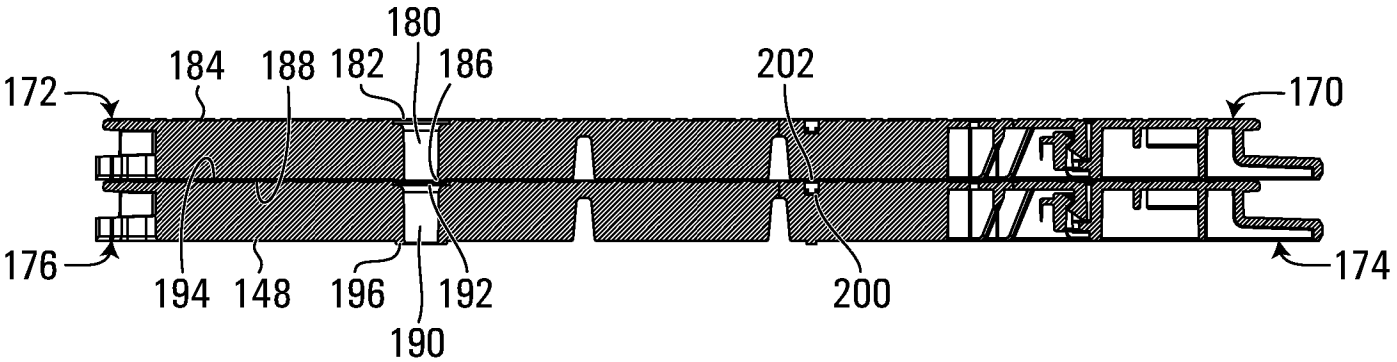

Multiple floor panels may be stacked vertically, for example to facilitate shipping. For example, FIG. 7 shows floor panels 170 and 172 connected by their respective non-channel-forming sides and stacked on top of floor panels 174 and 176 (only visible in FIG. 7B) also connected by their respective non-channel-forming sides. Floor panel 172 may have a spike-retaining bore 180 that is surrounded by an inset edge portion 182 of the top surface 184 and a projecting edge portion 186 of the bottom surface 188. Likewise, floor panel 176 may have a spike-retaining bore 190 that is surrounded by an inset edge portion 192 of the top surface 194 and a projecting edge portion 196 of the bottom surface 198. To reduce lateral sliding of the floor panels relative to each other when stacked (i.e. horizontal sliding), the inset edge portion 192 of floor panel 176 (on the bottom) may be adapted to receive the projecting edge portion 186 of floor panel 172 (on the top).

Lateral sliding of stacked floor panels 172 and 176 may be further or alternatively reduced using an opening 200 defined in the top surface 194 of floor panel 176 that is adapted to receive a stacking projection 202 on the bottom surface 188 of floor panel 172.

While specific embodiments of the invention have been described and illustrated, such embodiments should be considered illustrative of the invention only and not as limiting the invention as construed in accordance with the accompanying claims.

What is claimed is:

1. A first floor panel connectable to a second floor panel in an array having a contiguous channel for retainably housing a cable, wherein the array comprises repeating panel units, each panel unit of the repeating panel units comprises at least two floor panels, and the contiguous channel is formed through, between or through and between respective panel units, said first floor panel comprising:

a body having a generally planar top surface, a bottom surface defining a bottom plane, and a first side;

wherein said first side comprises a cable-retaining lip proximal to said top surface and an interlocking support proximal to said bottom plane;

wherein said interlocking support comprises an interlocking surface that is shaped to interlock with a corresponding side of the second floor panel to form a segment of the contiguous channel between said first side of said first floor panel and the corresponding side of the second floor panel;

wherein said segment of the contiguous channel is adapted to retainably house the cable, spaced apart from said bottom plane.

2. The first floor panel of claim 1, wherein said interlocking surface comprises either or both of:

curved projections extending outward from said first side; and curved recesses shaped and disposed to receive corresponding curved projections of the second floor panel corresponding to said curved projections of said first floor panel.

3. The first floor panel of claim 1, wherein said interlocking support is shaped to interlock with the corresponding side of the second floor panel such that movement of said first floor panel relative to the second floor panel is restricted along a lateral plane parallel to said bottom plane.

4. The first floor panel of claim 3, wherein said interlocking support is shaped to interlock with the corresponding side of the second floor panel such that movement of said first floor panel relative to the second floor panel is restricted along a transverse plane perpendicular to said lateral plane.

5. The first floor panel of claim 4, wherein:

said interlocking support is shaped to interlock with the corresponding side of the second floor panel such that said first floor panel is movable relative to the second floor panel along said lateral plane between a seated and unseated position; and movement along the transverse plane of said first floor panel relative to the second floor panel is restricted in the seated position and not restricted in the unseated position.

6. The first floor panel of claim 3, wherein said interlocking support comprises either or both of:

one or more generally T-shaped projections which each extend and widen outward from said first side along said lateral plane; and one or more generally T-shaped retainers respectively shaped and disposed for retaining corresponding generally T-shaped projections of the second floor panel corresponding to said one or more generally T-shaped projections of said first floor panel.

7. The first floor panel of claim 6, wherein said one or more generally T-shaped projections comprise a plurality of generally T-shaped projections which extend and widen outward from said first side along said lateral plane.

8. The first floor panel of claim 6, wherein said one or more generally T-shaped retainers comprise a plurality of generally T-shaped retainers respectively shaped and disposed for retaining corresponding generally T-shaped projections of the second floor panel corresponding to said one or more generally T-shaped projections of said first floor panel.

9. The first floor panel of claim 6, wherein:

said interlocking support defines a first portion and a second portion juxtaposed along said lateral plane;

said one or more generally T-shaped projections comprise first and second generally T-shaped projections spaced apart on said first portion; and said one or more generally T-shaped retainers comprise first and second generally T-shaped retainers spaced apart on said second portion.

10. The first floor panel of claim 9, wherein said interlocking surface comprises either or both of:

curved projections extending outward from said first side; and curved recesses shaped and disposed to receive corresponding curved projections of the second floor panel corresponding to said curved projections of said first floor panel.

11. The first floor panel of claim 1, further comprising a second side and a hypotenusal side such that said first side, said second side, and said hypotenusal side together define an isosceles right triangle, wherein:

said hypotenusal side comprises connecting means for connecting to a corresponding hypotenusal side of the second floor panel such that said first floor panel and the second floor panel together form a square floor panel.

12. The floor panel of claim 11 wherein said hypotenusal side further comprises:

an inner face, an outer face, a retainer extending outward from said outer face proximal to said bottom plane, and a retainable member formed between said inner face and said outer face and oriented towards said bottom plane;

wherein said retainer defines a trench open towards said top surface and shaped and disposed to retain a corresponding retainable member disposed on the second floor panel.

13. The first floor panel of claim 11, wherein said second side is the same as said first side.

14. The first floor panel of claim 1, wherein said bottom surface comprises support ribs for supporting said top surface.

15. The first floor panel of claim 14, wherein:

said support ribs further comprise a stacking projection transversely extending away from said bottom plane; and said top surface defines an opening disposed and shaped to receive a corresponding stacking projection of the second floor panel when the second floor panel is stacked on said top surface of the first floor panel, for reducing lateral movement of said first floor panel relative to the second floor panel.

16. The first floor panel of claim 1, wherein said top surface has a raised tread for traction.

17. The first floor panel of claim 1, wherein said top surface and said bottom surface define a plurality of drainage bores extending through said body.

18. The first floor panel of claim 1, wherein said cable-retaining lip is adapted to overhang said segment of the contiguous channel so as to at least partially define a gap relative to a closest edge of the second floor panel that is less than 10 mm across.

19. The first floor panel of claim 1, wherein said body is integrally formed.

20. A modular flooring system comprising a plurality of interconnectable floor panels which includes the first floor panel of claim 1.

* * * * *